US009989331B2

(12) United States Patent
Swineheart et al.

(10) Patent No.: US 9,989,331 B2
(45) Date of Patent: Jun. 5, 2018

(54) ROTATING CONNECTOR FOR CONNECTING THE LOWER RECEIVER OF A RIFLE TO THE BUTT STOCK

(71) Applicants: Marty Swineheart, Alpine, CA (US); Kevin Brian Heath, El Cajon, CA (US)

(72) Inventors: Marty Swineheart, Alpine, CA (US); Kevin Brian Heath, El Cajon, CA (US)

( * ) Notice: Subject to any disclaimer, the term of this patent is extended or adjusted under 35 U.S.C. 154(b) by 0 days. days.

(21) Appl. No.: 15/366,423

(22) Filed: Dec. 1, 2016

(65) Prior Publication Data

US 2017/0160049 A1 Jun. 8, 2017

Related U.S. Application Data

(60) Provisional application No. 62/262,627, filed on Dec. 3, 2015.

(51) Int. Cl.
*F41C 23/20* (2006.01)
*F41C 23/06* (2006.01)

(52) U.S. Cl.
CPC ..... *F41C 23/20* (2013.01); *F41C 23/06* (2013.01)

(58) Field of Classification Search
CPC ..... F41C 23/20; F41C 23/04; F41C 23/06; F41C 23/08
USPC ..... 42/75.01, 75.03
See application file for complete search history.

(56) References Cited

U.S. PATENT DOCUMENTS 2,282,537 A 5/1942 Whitney
3,834,053 A * 9/1974 Bielfeldt ..... F41A 21/487 42/1.07
4,066,000 A * 1/1978 Rostocil ..... F41A 9/30 89/198
7,024,812 B2 4/2006 Nelson
7,716,865 B2 * 5/2010 Daniel ..... F41C 23/16 42/75.01
7,793,453 B1 9/2010 Sewell
8,186,090 B1 5/2012 Chiarolanza
8,276,303 B2 * 10/2012 Kapusta ..... F41C 23/16 42/71.01
8,464,458 B2 6/2013 Chvala
8,720,099 B1 5/2014 Sisk
(Continued)

FOREIGN PATENT DOCUMENTS

DE 3743092 A1 7/1988

*Primary Examiner* — Stephen Johnson
(74) *Attorney, Agent, or Firm* — Atlanta Technology Law

(57) ABSTRACT

The present invention is a rotating connector for attaching the lower receiver of a rifle to the butt stock. The rotating connector comprises an outer bushing, an inner bushing and at least one bushing cap. The outer bushing includes a flat bottom portion, at least two threaded holes and at least one hollow interior cavity. The flat bottom portion of the outer bushing comprises a first hole and a second hole in which the first hole includes at least one stainless steel ball, a spring plunger and a spring. The second hole includes at least one bushing stop. The at least one stainless steel ball, the spring plunger, the spring in the first hole and the at least one bushing stop in the second hole are held in place utilizing at least one set screw. The inner bushing includes a plurality of recesses having a threaded hollow cavity configured to receive the butt stock of the rifle.

19 Claims, 6 Drawing Sheets

(56) References Cited

U.S. PATENT DOCUMENTS

| | | | | |
|---|---|---|---|---|
| 8,915,005 | B2 | 12/2014 | Grimshaw | |
| 9,395,149 | B2 | 7/2016 | Stanley | |
| 9,417,032 | B1 | 8/2016 | Chiang | |
| 2007/0017139 | A1* | 1/2007 | Larue | F41C 23/16 42/75.1 |
| 2008/0028662 | A1 | 2/2008 | Abraham | |
| 2012/0036757 | A1 | 2/2012 | LaRue | |
| 2013/0097911 | A1 | 4/2013 | LaRue | |
| 2015/0345881 | A1 | 12/2015 | Irvin | |
| 2016/0202016 | A1 | 7/2016 | Mather | |

* cited by examiner

ROTATING CONNECTOR FOR CONNECTING THE LOWER RECEIVER OF A RIFLE TO THE BUTT STOCK

RELATED APPLICATION

This application claims priority to Application Ser. No. 62/262,627 filed on Dec. 3, 2015, which is incorporated by reference.

FIELD OF THE DISCLOSURE

The present disclosure relates generally to firearm stocks for shoulder-fired weapons. More specifically, the invention permits a rifle's receiver or other long arm's stock to rotate independently from the rifle's butt stock around the horizontal axis to permit increased accuracy in difficult firing situations.

DISCUSSION OF RELATED ART

Traditionally butt stocks are a simple, rigid component extending from the receiver of the firearm rearward and engage the user's shoulder when the firearm is in the shoulder firing position. It is also important for a rifle butt stock to be simple and reliable, with a small number of parts, quickly and quietly adjustable, and very rugged. Increasing the adjustability of the butt stock increases the accuracy of firing when changing target points or firing positions. However, currently making butt stock adjustments in the field for accurate firing can be difficult and time consuming.

Conventional methods include many types of rifle butt stocks that allow the user to make adjustments to the length of pull and cheek rest height to improve the comfort, fit, and flexibility of the rifle for the individual user. Many different methods are used to secure and release the moving pieces. Some stocks require the loosening and tightening of nuts and bolts to change positions.

Another method describes a mechanism, which may be integral with the firearm parts, and allows the butt of a shouldered firearm, that either shoots shot or projectiles, to be pivoted about an axis; or where the stock butt is pivoted by design and fixed in place allowing the butt of a shoulder-fired weapon to be pivoted about a central point. However, this mechanism only applies to shouldered firearms where the firing mechanism, barrel, and sighting device are elevated above the stock butt.

Yet another method describes a rapidly-adjustable butt stock assembly comprised of a butt stock, a buffer, a slot cylinder, a key cylinder, and keys. The butt stock has a cylindrical recess with lengthwise key grooves for receiving the slot and key cylinders. The key cylinder is attached to the buffer and carries one or more keys, in which keys extend through the key cylinder and the slot cylinder and into the key grooves of the butt stock. The slot cylinder has at least one lengthwise slot with a plurality of transverse slots extending from it. To adjust the length of the assembly, the user rotates the slot cylinder so that the keys rotate out of the transverse slots and into the lengthwise slot of the slot cylinder thus permitting the key cylinder to move axially with respect to the butt stock. However, this mechanism can prevent the butt stock from fitting firmly on the user's shoulder, which can prevent the rest of the weapon from rotating to aim at the target.

Therefore, there is a need for a mechanism that allows the butt stock portion of the shouldered firearm to remain in a 90 degree vertical position tucked into the user's shoulder, while the rest of the weapon can be rotated around the vertical axis. Such a needed device would provide the capability to keep a firearm firmly against the user's shoulder while rotating to another sight mounted on the side of the weapon. This mechanism would be relatively easy to adjust and allow the user to improve the comfort, fit, and flexibility of the weapon under difficult firing conditions. Moreover, such a needed mechanism would increase the adjustability of the butt stock and the accuracy of firing. The present embodiment overcomes prior art shortcomings by accomplishing these critical objectives.

SUMMARY OF THE INVENTION

To minimize the limitations found in the prior art, and to minimize other limitations that will be apparent upon the reading of the specification, the present invention is a rotating connector attaching the lower receiver of a rifle to the butt stock. The invention allows the butt stock to remain in a 90 degree vertical position tucked into the user's shoulder while the rest of the weapon can be rotated continuously around the vertical axis against the force of the spring to maximum rotation to 45 degrees from the horizontal and more preferably 30 degrees from the horizontal. This provides the capability to keep the weapon firmly against the user's shoulder while rotating to another sight mounted on the side of the weapon. In the rotated position if weapon is removed from the shoulder, the butt stock will return to the neutral 90 degree position with the help of the spring.

The preferred embodiment comprises an outer bushing, an inner bushing and at least one bushing cap. The outer bushing includes a flat bottom portion, at least two threaded holes and at least one hollow interior cavity. The flat bottom portion of the outer bushing comprises a first hole and a second hole in which the first hole is on the left side and second hole is on the right side of the flat bottom portion. The first hole includes at least one stainless steel ball, a spring plunger and a spring. The second hole includes at least one bushing stop. The at least one stainless steel ball, the spring plunger, the spring in the first hole and the at least one bushing stop in the second hole are held in place utilizing at least one set screw. The spring plunger and the spring in the first hole are frictionally attached to each other. The bushing stop permits the continuous rotation of the lower receiver to a maximum rotation of 45 degrees from the horizontal and more preferably 30 degrees from the horizontal. For a left handed user the contents of the first hole and second hole are reversed. The inner bushing is inserted into the at least one hollow interior cavity of the outer bushing. The inner bushing includes a plurality of recesses having a threaded hollow cavity configured to receive the butt stock of the rifle. The inner bushing fits inside the at least one hollow interior cavity of the outer bushing and the plurality of recesses permit and limit the range of rotation of the lower receiver. The rotation of the lower receiver is achieved by depressing the spring. The plurality of recesses in the inner lip of the inner bushing are in direct contact with the contents of the first hole and second hole on the flat bottom portion of the outer bushing. The at least one stainless ball in the first hole is in direct contact with the spring plunger and the plurality of recesses in the inner bushing. The plurality of recesses in the inner bushing is in direct contact with the at least one bushing stop. A plurality of shims are inserted at the at least one hollow interior cavity of the outer bushing. The plurality of shims may be of stainless steel or any other light weights, high strength alloys or other wear-resistant plastics. The rotating connector further comprises at least one removable bushing cap attached to at least two threaded holes of the outer bushing utilizing a plurality of threaded fasteners configured to fit over the inner bushing to hold it in the outer bushing.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DESCRIPTION OF THE PREFERRED EMBODIMENTS

The following discussion addresses a number of embodiments and applications of the present invention. Reference is made to the accompanying drawings which illustrate specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below. The invention will now be described with reference to the accompanying drawing which does not limit the scope and the ambit of the invention.

Figure 1:
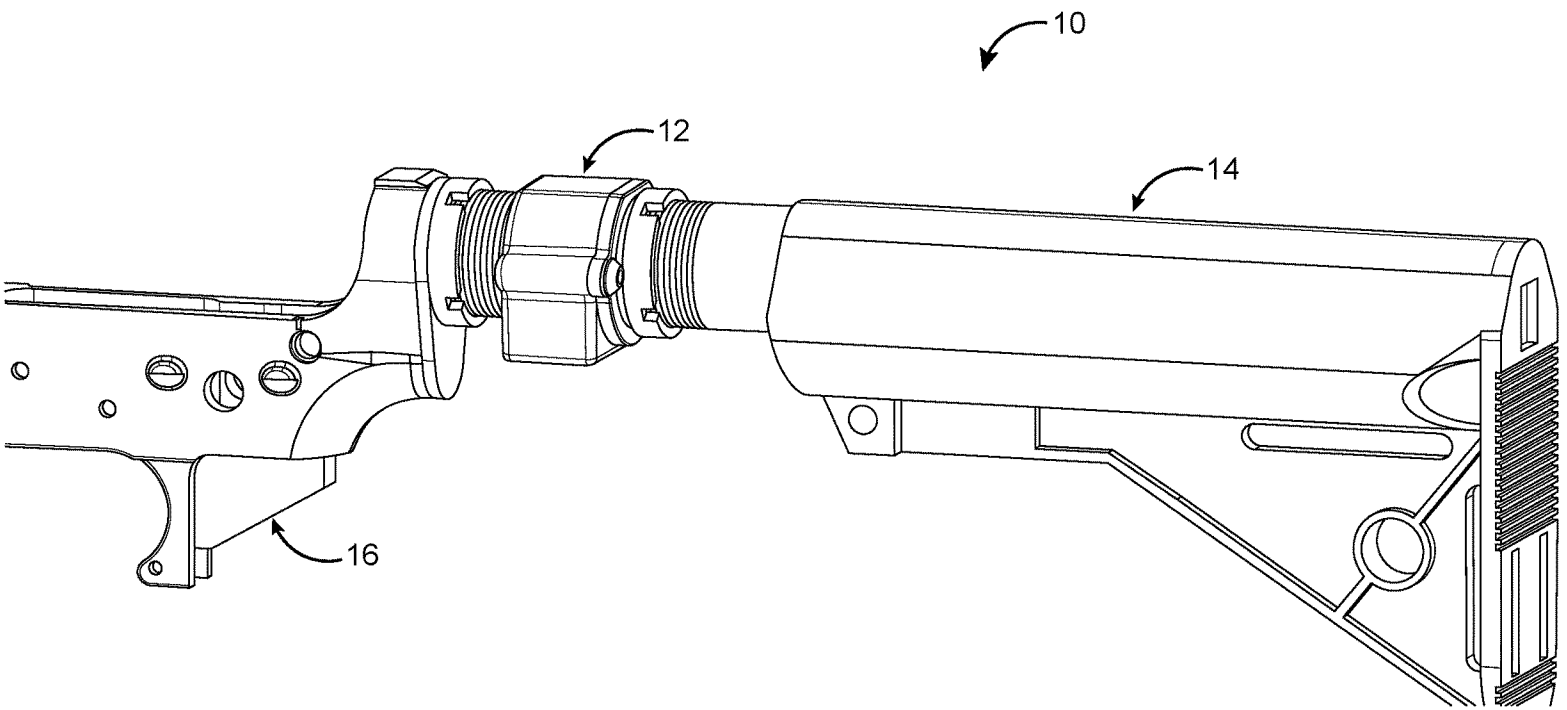
FIG. 1 is a perspective view of a rotating connector for connecting a lower receiver of a rifle to a butt stock installed on an AR15 style rifle according to the preferred embodiment of the present invention.

Turning first to FIG. 1, a perspective view of a rotating connector 12 for connecting a lower receiver 16 of a rifle 10 to a butt stock 14 installed on an AR15 style rifle 10 according to the preferred embodiment of the present invention is illustrated. A rotating connector 12 connected between the butt stock 14 and the lower receiver 16 of the rifle 10 permits the lower receiver 16 to be rotated around the horizontal axis of the rifle's 10 barrel independently of the butt stock 14.

Figure 2:
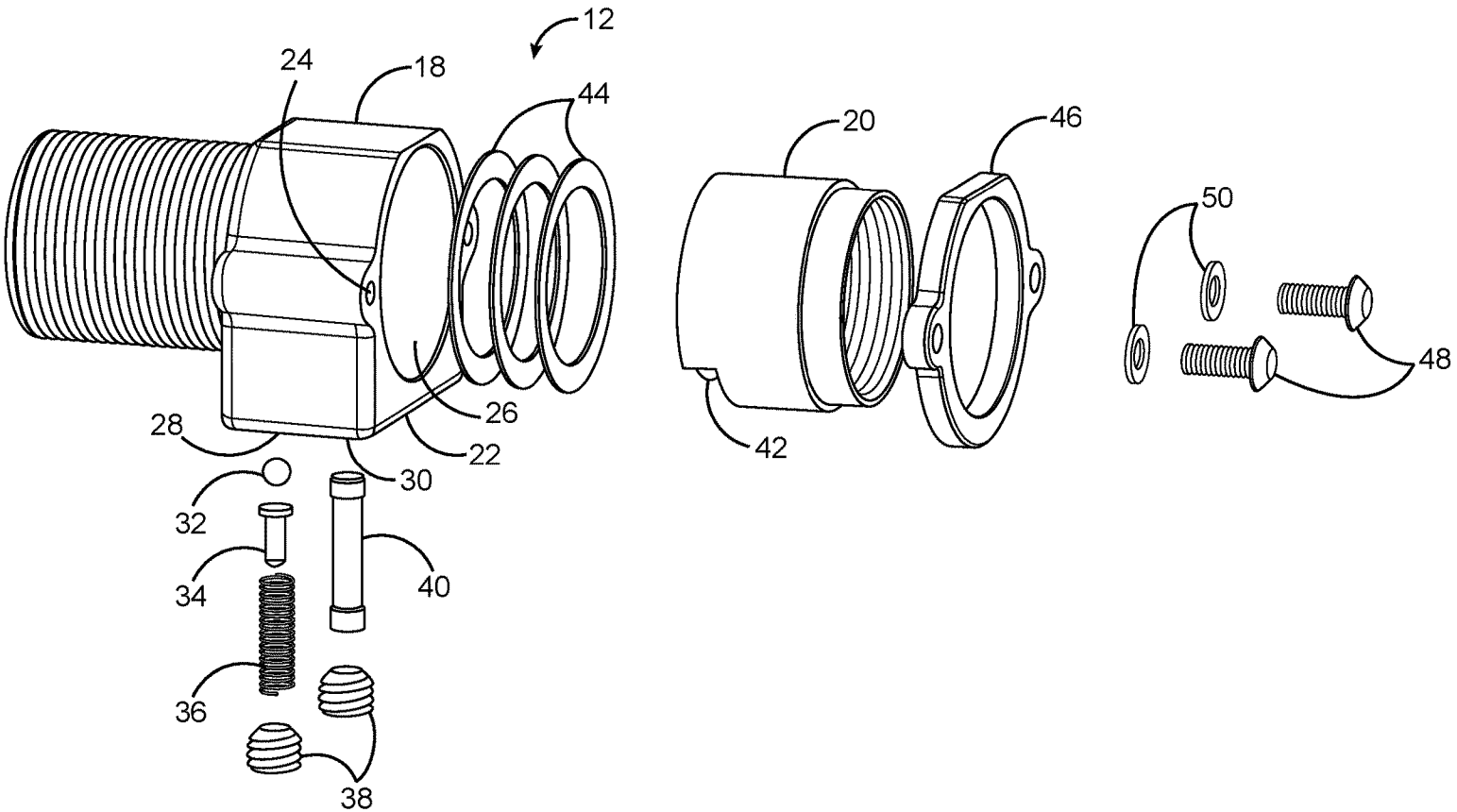
FIG. 2 is an exploded view of the rotating connector for connecting the lower receiver of the rifle to the butt stock according to the preferred embodiment of the present invention.

Referring to FIG. 2, an exploded view of the rotating connector 12 for connecting the lower receiver 16 of the rifle 10 to the butt stock 14 according to the preferred embodiment of the present invention is depicted. The preferred embodiment comprises an outer bushing 18, an inner bushing 20 and at least one bushing cap 46. The outer bushing 18 includes a flat bottom portion 22, at least two threaded holes 24 and at least one hollow interior cavity 26. The outer bushing 18 may be machined as an individual part as an aftermarket add on or machined as part of the lower receiver 16. The flat bottom portion 22 of the outer bushing 18 comprises a first hole 28 and a second hole 30 in which the first hole 28 is on the left side and second hole 30 is on the right side of the flat bottom portion. The first hole 28 includes at least one stainless steel ball 32, a spring plunger 34 and a spring 36 wherein the second hole includes at least one bushing stop 40. The at least one stainless steel ball 32, the spring plunger 34, the spring 36 in the first hole 28 and the at least one bushing stop 40 in the second hole 30 are held in place utilizing at least one set screw 38. For a left handed user, the contents of the first hole 28 and second hole 30 are reversed.

Figure 3:
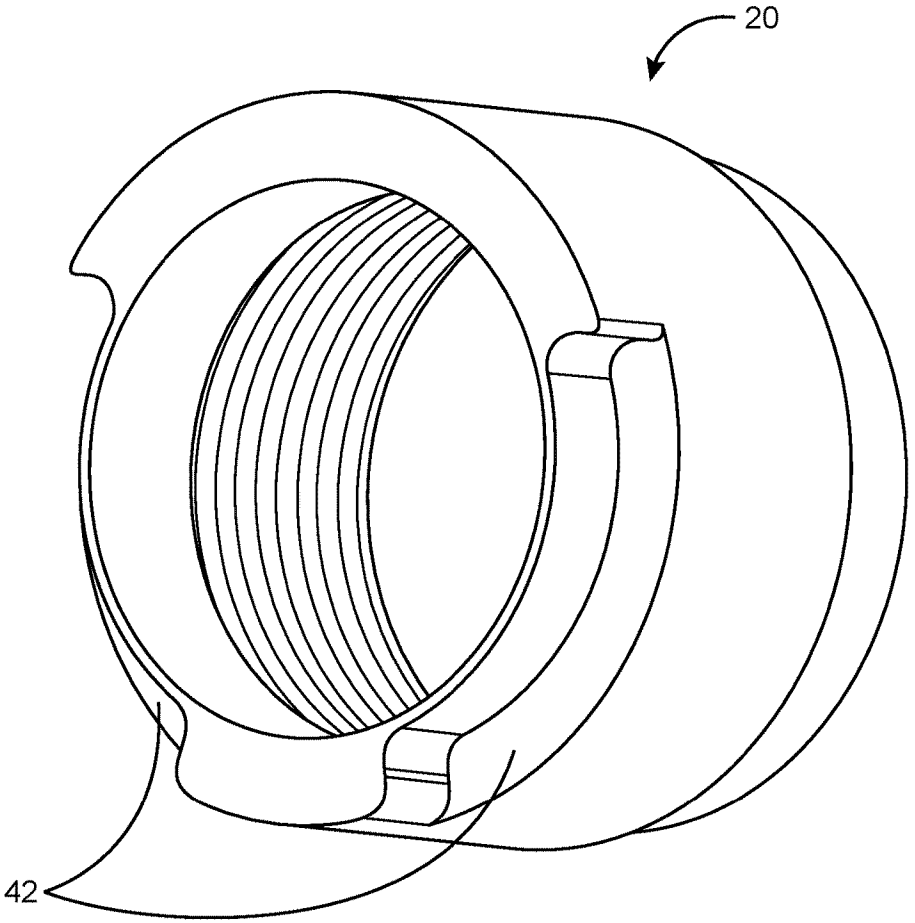
FIG. 3 is a perspective view of the inner bushing of the rotating connector for connecting the lower receiver of the rifle to the butt stock according to the preferred embodiment of the present invention.

FIG. 3 is a perspective view of the inner bushing 20 of the rotating connector 12 for connecting the lower receiver 16 of the rifle 10 to the butt stock 14 according to the preferred embodiment of the present invention. The inner bushing 20 is inserted into the at least one hollow interior cavity 26 of the outer bushing 18. The inner bushing 20 includes a plurality of recesses 42 having a threaded hollow cavity configured to receive the butt stock 14 of the rifle 10. The inner bushing 20 fits inside the at least one hollow interior cavity 26 of the outer bushing 18 and the plurality of recesses 42 permit and limit the range of rotation of the lower receiver 16. A plurality of shims 44 are inserted at the at least one hollow interior cavity 26 of the outer bushing 18. The plurality of shims 44 may be of stainless steel or any other light weights, high strength alloys or other wear-resistant plastics. The rotating connector 12 further comprises at least one bushing cap 46 removably attached to at least two threaded holes 24 of the outer bushing 18 utilizing a plurality of threaded fasteners 48 and a plurality of outer washers 50, configured to fit over the inner bushing 20 to hold it in the outer bushing 18. The inner bushing 20 has a lip that fits inside at least one bushing cap 46 that permits the butt stock 14 to be thread into the inner bushing 20.

Figure 4A:
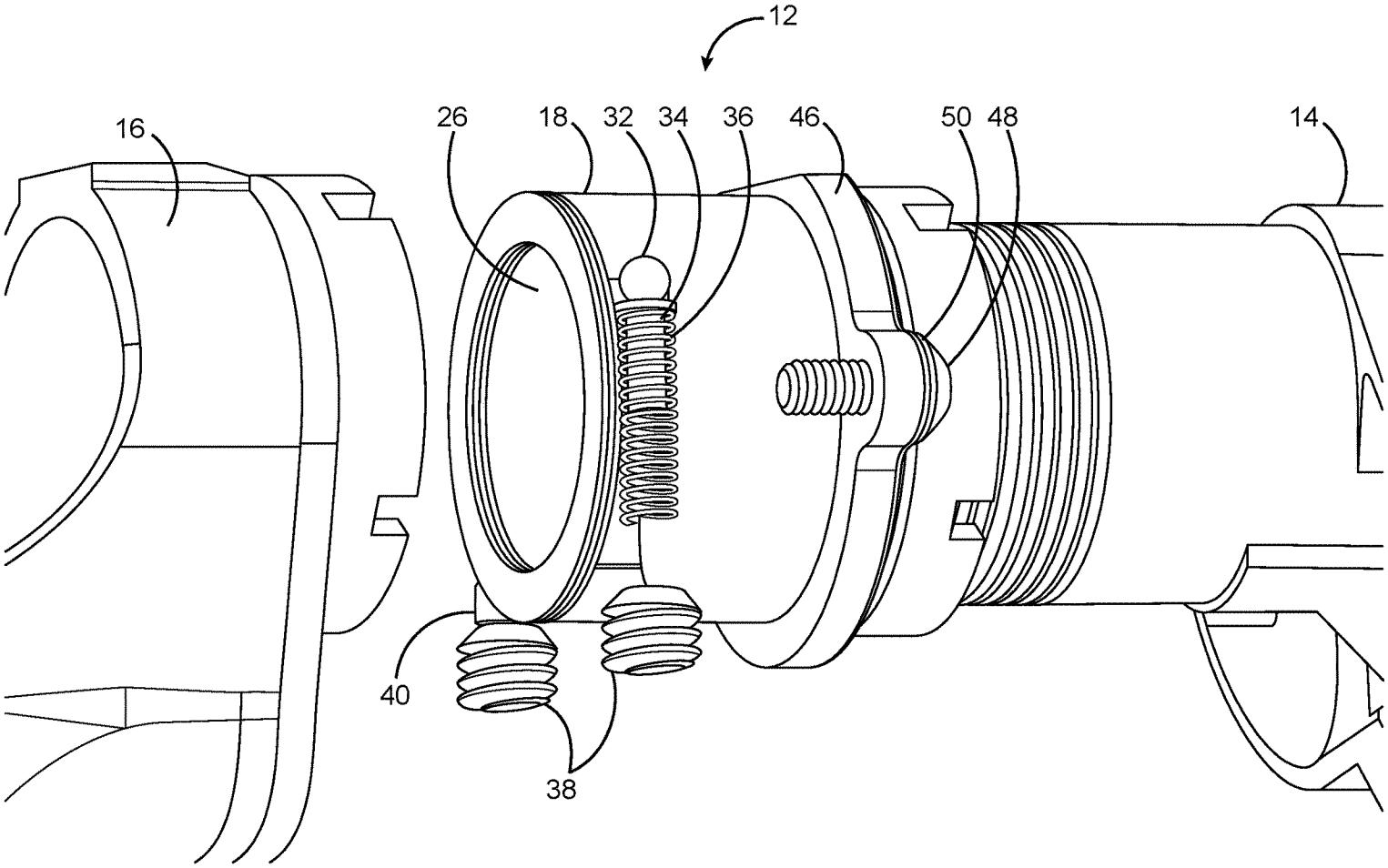
FIGS. 4A & 4B illustrate the position of at least one stainless steel ball, a spring plunger and a spring in a first hole of a flat bottom portion of the rotating connector during the normal position and the rotating position of the rifle respectively according to the preferred embodiment of the present invention.
Figure 4B:
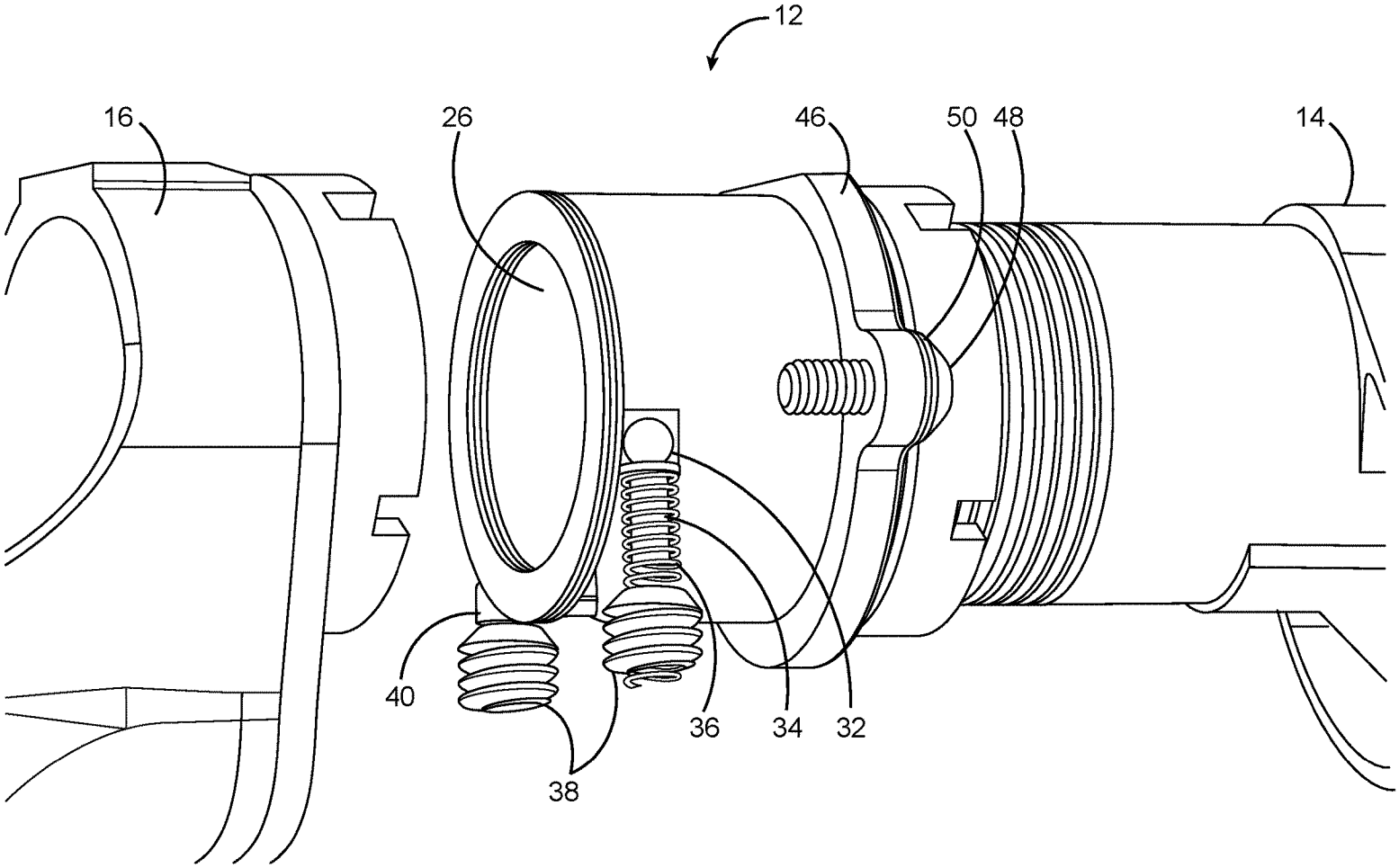

FIGS. 4A & 4B illustrate the position of the at least one stainless steel ball 32, the spring plunger 34 and the spring 36 in the first hole 28 of the flat bottom portion 22 of the rotating connector 12 during the normal position and the rotating position of the rifle 10 respectively according to the preferred embodiment of the present invention. The spring plunger 34 and the spring 36 in the first hole 28 are frictionally attached to each other. The bushing stop 40 allows the rotation of the lower receiver 16 to 30 degrees. The rotation of the lower receiver 16 is activated by depressing the spring 36. The plurality of recesses 42 in the inner lip of the inner bushing 20 is in direct contact with the contents of the first hole 28 and second hole 30 on the flat bottom portion 22 of the outer bushing 18. The at least one stainless ball 32 in the first hole 28 is in direct contact with the spring plunger 34 and the plurality of recesses 42 in the inner bushing 20. The plurality of recesses 42 in the inner bushing 20 is in direct contact with the at least one bushing stop 40 also.

Figure 5:
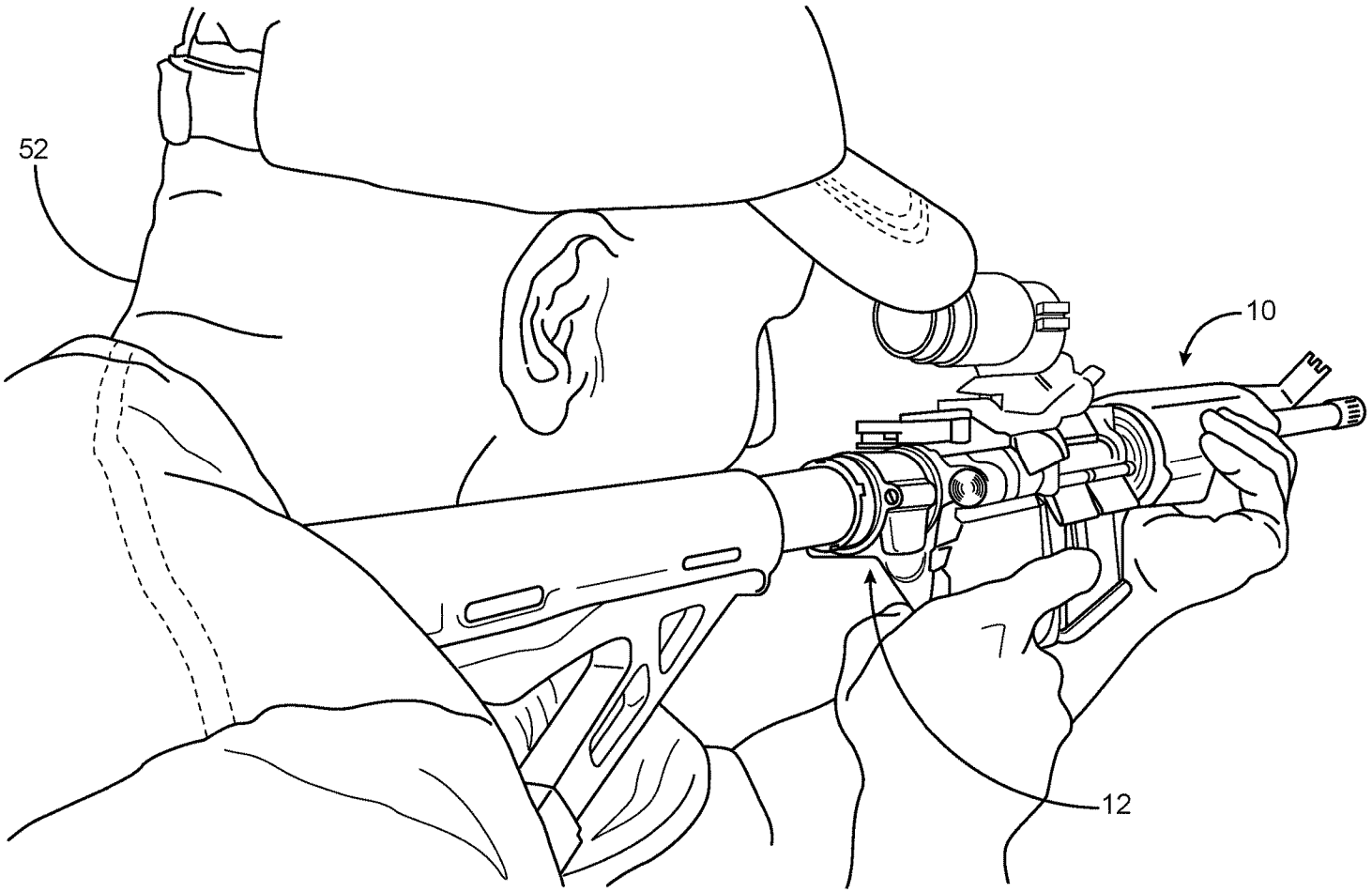
FIG. 5 is a perspective view of the rotating connector for connecting the lower receiver of the rifle to the butt stock in use according to the preferred embodiment of the present invention.

FIG. 5 is a perspective view of the rotating connector 12 for connecting the lower receiver 14 of the rifle 10 to the butt stock 16 in use according to the preferred embodiment of the present invention. The rotating connector 12 allows the butt stock portion 16 of the stock to remain in a 90 degree vertical position tucked into the user's 52 shoulder while the rest of the weapon can be rotated continuously around the vertical axis against the force of the spring 36 to a maximum rotation to 45 degrees from the horizontal and more preferably 30 degrees from the horizontal. This allows the user 52 to keep the weapon 10 firmly against the user's 52 shoulder while rotating to another sight mounted on the side of the weapon 10. In the rotated position if weapon 10 is removed from the shoulder the butt stock 14 will return to the neutral 90 degree position with the help of the spring 36. The outer bushing 18 and inner bushing 20 is very unique in the way that allows the user 52 to stay locked on a target in a way that can keep the weapon 10 on the target while switching between optics. Both outer bushing 18 and inner bushing 20 allow the user 52 to keep their cheek and head on the butt stock 14 of the weapon 10. The automatic spring return is there, so the butt stock 14 returns to normal position. The user 52 needs this return so when the weapon 52 is pulled away from the shoulder he or she knows that the butt stock will return to its standard position.

Other embodiments are within the claims. The preceding recitation is provided as an example of the preferred embodiment and an alternate embodiment for illustrative purposes and is not meant to limit the nature or scope of the present appended claims. Variations of the invention are anticipated by those skilled in the art.

What is claimed is:

1. A rotating connector for connecting a lower receiver of a rifle to a butt stock comprising:

an outer bushing with a hollow interior cavity, wherein the outer bushing also has a flat bottom portion with a left bottom side and a right bottom side;

wherein the flat bottom portion of the outer bushing includes a first bottom hole on the left bottom side extending from the flat bottom of the outer bushing to the hollow interior cavity of the outer bushing and a second bottom hole on the right side of the flat bottom portion of the outer bushing extending from the flat bottom of the outer bushing to the hollow interior cavity of the outer bushing, the first bottom hole includes at least one first stainless steel ball, a first spring plunger and a first spring and the second hole includes at least one bushing stop, at least one second stainless steel ball, and a second spring plunger, the first spring in the first bottom hole and the at least one bushing stop in the second bottom hole are held in place by set screws;

an inner bushing inserted into the hollow interior cavity of the outer bushing; and at least one removable bushing cap attached to a substantially perpendicular surface to the flat bottom of the outer bushing that has at least two threaded holes;

whereby the at least one bushing cap is configured to fit over the inner bushing to hold the inner bushing in the outer bushing.

2. The rotating connector of claim 1 wherein the at least one hollow interior cavity of the outer bushing includes a plurality of shims.

3. The rotating connector of claim 1 wherein the inner bushing includes a threaded hollow cavity configured to receive the butt stock.

4. The rotating connector of claim 1 wherein the lower receiver is permitted to rotate by depressing the spring.

5. A rotating connector for connecting a lower receiver of a rifle to a butt stock, the rotating connector comprises:

an outer bushing, the outer bushing includes a flat bottom portion having a left bottom side and a right bottom side, and at least two threaded outer bushing holes and at least one hollow interior cavity;

a first bottom hole on the left bottom side and a second bottom hole on the right bottom side of the flat bottom portion of the outer bushing;

a plurality of shims inserted in the at least one hollow interior cavity of the outer bushing;

an inner bushing with an inner lip having a plurality of recesses, wherein the inner bushing is inserted into the at least one hollow interior cavity of the outer bushing, the inner bushing includes a plurality of recesses having a threaded hollow cavity configured to receive the butt stock; and at least one bushing cap removably attached to the at least two threaded outer bushing holes of the outer bushing utilizing a plurality of threaded fasteners and a plurality of outer washers;

whereby the at least one bushing caps is configured to fit over the inner bushing to hold the inner bushing in the outer bushing.

6. The rotating connector of claim 5 wherein the first bottom hole includes at least one stainless steel ball, a spring plunger and a spring.

7. The rotating connector of claim 6 wherein the at least one stainless steel ball is in direct contact with the spring plunger and the plurality of recesses in the inner bushing.

8. The rotating connector of claim 6 wherein the spring plunger is frictionally attached to the spring.

9. The rotating connector of claim 6 wherein the lower receiver is permitted to rotate by depressing the spring.

10. The rotating connector of claim 5 wherein the second bottom hole includes at least one bushing stop.

11. The rotating connector of claim 10 wherein the least one bushing stop is in direct contact with the plurality of recesses in the inner bushing.

12. The rotating connector of claim 5 wherein at least one stainless steel ball, a spring plunger, and a spring are held in place in the first bottom hole by a set screw and at least one bushing stop is held in place in the second bottom hole by a set screw.

13. The rotating connector of claim 5 wherein the plurality of recesses in the inner lip of the inner bushing is in direct communicative contact with the contents of the first bottom hole and the second bottom hole.

14. A rotating connector for connecting a lower receiver of a rifle to a butt stock, the rotating connector comprises:

an outer bushing, the outer bushing includes a flat bottom portion having a left bottom side and a right bottom side, and at least two threaded outer bushing holes and at least one hollow interior cavity;

a first bottom hole on the left bottom side and a second bottom hole on the right bottom side of the flat bottom portion of the outer bushing, the contents of the first bottom hole comprises at least one first stainless steel ball, a first spring plunger and a first spring and the contents of the second bottom hole comprises at least one bushing stop, at least one second stainless steel ball, and a second spring plunger, the first spring in the first hole and the at least one bushing stop in the second hole being held in place utilizing at least one set screw;

a plurality of shims inserted in the at least one hollow interior cavity of the outer bushing;

an inner bushing with an inner lip having a plurality or recesses, wherein the inner bushing is inserted into the at least one hollow interior cavity of the outer bushing, the inner bushing includes a plurality of recesses having a threaded hollow cavity configured to receive the butt stock; and at least one removable bushing cap attached to the at least two threaded holes of the outer bushing utilizing a plurality of threaded fasteners and a plurality of outer washers;

whereby the at least one bushing cap is configured to fit over the inner bushing to hold the inner bushing in the outer bushing.

15. The rotating connector of claim 14 wherein the plurality of recesses in the inner lip of the inner bushing is in direct communicative contact with the contents of the first bottom hole and the second bottom hole.

16. The rotating connector of claim 14 wherein the at least one first stainless steel ball is in direct contact with the first spring plunger and the plurality of recesses in the inner bushing.

17. The rotating connector of claim 14 wherein the least one bushing stop is in direct contact with the plurality of recesses in the inner bushing.

18. The rotating connector of claim 14 wherein the first spring plunger is frictionally attached to the first spring.

19. The rotating connector of claim 14 wherein the lower receiver is permitted to rotate by depressing the spring.

* * * * *